United States Patent [19]

Miller

[11] Patent Number: 4,589,137

[45] Date of Patent: May 13, 1986

[54] ELECTRONIC NOISE-REDUCING SYSTEM

[75] Inventor: Harry B. Miller, Niantic, Conn.

[73] Assignee: The United States of America as represented by the Secretary of the Navy, Washington, D.C.

[21] Appl. No.: 688,662

[22] Filed: Jan. 3, 1985

[51] Int. Cl.[4] ..... H04R 27/00

[52] U.S. Cl. ..... 381/94; 381/71; 381/92

[58] Field of Search ..... 381/94, 71, 92, 111, 381/107, 108

[56] References Cited

U.S. PATENT DOCUMENTS

| | | | |
|---|---|---|---|
| 4,025,721 | 5/1977 | Graupe | 381/94 |
| 4,153,815 | 5/1979 | Chaplin | 381/71 |
| 4,308,425 | 12/1981 | Momose | 381/92 |
| 4,354,059 | 10/1982 | Ishigaki | 381/92 |
| 4,417,098 | 11/1983 | Chaplin | 381/71 |
| 4,420,655 | 12/1983 | Suzuki | 381/94 |
| 4,489,441 | 12/1984 | Chaplin | 381/94 |
| 4,536,887 | 8/1985 | Kaneda | 381/94 |

FOREIGN PATENT DOCUMENTS

| | | | |
|---|---|---|---|
| 59-64994 | 4/1984 | Japan | 381/92 |

*Primary Examiner*—Gene Z. Rubinson
*Assistant Examiner*—L. C. Schroeder
*Attorney, Agent, or Firm*—Robert F. Beers; Arthur A. McGill; Prithvi C. Lall

[57] ABSTRACT

A method and apparatus for reducing noise from a near-field noise source present together with signals from a far-field source. The method uses an adaptive shaping filter and a summer, in conjunction with a directional reference sensor and a primary sensor which have at least a common sensing element therebetween. The directional reference sensor situated between the near-field noise source and the far-field signal source, rejects the broad-band signal but accepts the broad-band noise and feeds this noise into a reference channel of the adaptive filter. The primary sensor accepts both the far-field signal and near-field noise with equally sensitivity. The primary sensor feeds into the primary channel of the adaptive filter. The adaptive filter system subtracts the noise in the reference channel from the signal-plus-noise in the primary channel, thus producing an output having a greatly improved signal-to-noise ratio.

7 Claims, 15 Drawing Figures

ELECTRONIC NOISE-REDUCING SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

Subject invention is related to signal processing and more particularly to an adaptive filter for cancelling noise without affecting the signal and thereby increasing the signal-to-noise ratio.

2. Description of the Prior Art

There are many occasions when a microphone is required to pick up sound from a talker or loudspeaker situated to the right of the microphone, while simultaneously there is intense noise radiating from a noise source to the left of the microphone. Noise-cancelling or noise-reducing devices based on transmission loss, such as, for example, sound absorbers placed between the microphone and the noisy wall enclosing a machine shop, provide one method of reducing the noise (acoustically) *before* it is picked up by the microphone. However, the sound-absorbing material often occupies a large volume, and when the signal bandwidth is extended to include the low end of the audio bandwidth, this volume can be unacceptably large.

An alternate and more desirable method is to use an electronic noise-cancelling or noise-reducing system to reduce the transduced noise (now in electrical form) *after* the microphone has picked it up.

SUMMARY OF THE INVENTION

An electronic noise cancelling system according to the teachings of subject invention includes a reference sensor comprising a short endfire line of electroacoustic elements, e.g., microphone elements, situated outside a noisy wall and positioned perpendicular to the wall. This sensor, accepting predominantly wall noise, feeds into a small adaptive filter system. A second sensor, the primary sensor, accepting signal plus noise, also feeds into the adaptive filter system. The adaptive filter system comprises an adaptive shaping filter or equalizer of both phase and amplitude, and a summer. Ideally, the system subtracts the pure wall noise from the combination of signal plus wall noise, leaving pure signal. [It should be pointed out that simple subtraction accomplishes only little. An adaptive shaping filter must be inserted into the system to pre-process the wall noise prior to subtraction.] The system greatly increases the signal/noise ratio. It does this by reducing the response to broadband wall noise over a wide frequency band, without reducing the response to the signal source.

An object of subject invention is to have a noise cancelling system which does not require a large volume of sound-absorbing material.

Another object of subject invention is to have a noise canceling system which reduces the noise over a wide frequency bandwidth.

Still another object of subject invention is to have a noise-cancelling or noise-reducing system which greatly enhances the signal-to-noise ratio for both male (low frequencies) and female (high frequencies) talkers.

Other objects, advantages and novel features of the invention may become apparent from the following detailed description of the invention when considered in conjunction with the accompanying drawings wherein:

DESCRIPTION OF THE PREFERRED EMBODIMENT

The method in subject invention requires that two different sensors (a reference sensor and a primary sensor) feed into an adaptive filter system. The reference sensor supplies a signal-free running (i.e., continuously varying with time) wall noise input. This running wall noise input, after both its phase and amplitude have been manipulated by the adaptive filter, is then subtracted from the primary sensor's running signal-plus-noise input. Ideally, only the wall noise is reduced at the output. The signal at the primary sensor, being incoherent with the wall noise there, is not reduced. Hence the signal/noise ratio can be greatly increased.

One reason for this improvement lies in the nature of the adaptive filter system, which is basically an adaptive equalizer plus a summer. The adaptive filter system using the so called LMS (Least Mean Squares) algorithm has been used for many years. An important part of the operation is that this filter system adaptively adjusts the frequency response of the reference sample (noise alone) in both phase and amplitude so as to equal the frequency response of the primary sample's noise component while ignoring the primary sample's signal component. This is feasible due to the properties of coherence, and the method works when the primary noise and the reference noise are highly coherent.

A second reason for this improvement lies in our taking advantage of the art of close-talking microphones. Consider a dipole consisting of two spaced omnidirectional electro acoustic elements, element #2 and element #1, having the same sensitivity but a relative phase of 180 degrees. This dipole displays a figure-8 pattern and a 6 db/oct frequency response toward a far-field source, but displays an almost omnidirectional pattern and an almost flat frequency response toward a near-field source if that source is much closer to element #2 than to element #1. A similar comment applies to a tripole when the near-field source is much closer to element #3 than to element #2 or element #1. (Of course, the far-field pattern is now a cardioid rather than a figure-8.)

But it should be noted that there is an important difference in the way the art of close-talking microphones is used in this inventive concept as opposed to the way the art of close-talking microphones has been conventionally used. In the conventional application of the art, the dipole or tripole microphone is caused to enhance the desired signal and reduce the noise. In the present invention, the close-talking dipole or tripole microphone is caused to do just the opposite: to enhance the noise and reduce the desired signal. This reverse application of the art of close-talking microphones is an essential part of the invention.

Figure 7:
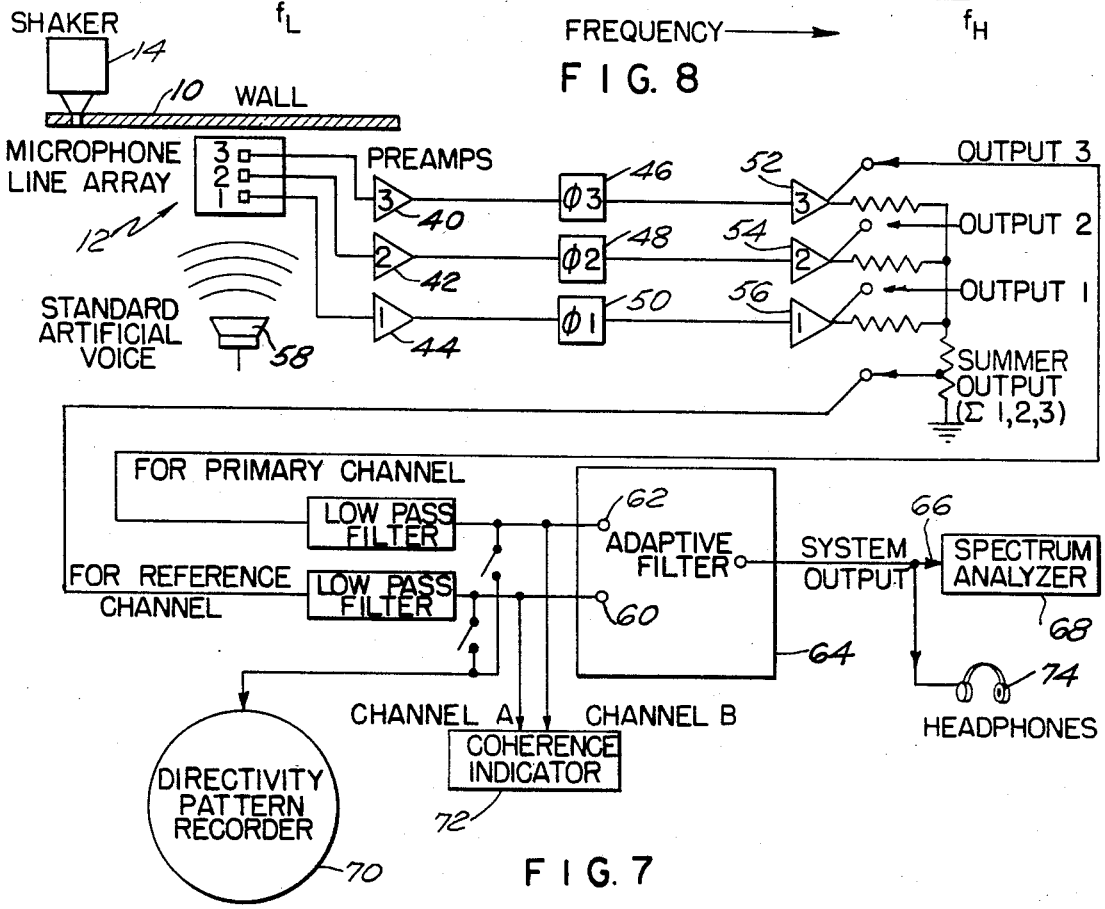
FIG. 7 is a more detailed block diagram of the noise cancelling or reducing system.

In subject inventive concept, the primary sensor feeds into a primary channel and the reference sensor feeds into a reference channel of the adaptive filter, as shown in FIG. 7. Now in the prior art, the primary sensor and the reference sensor are two independent entities, physically separated. For example, the primary sensor would be an omnidirectional or a directional microphone pointing toward the signal source, and the reference sensor would be an accelerometer rigidly attached to the wall. This method suffers from two drawbacks: the noise in the reference sensor is not sufficiently coherent with the noise in the primary sensor; and the total sound (undesired signal plus noise) in the reference sensor is not sufficiently signal-free.

Figure 6:
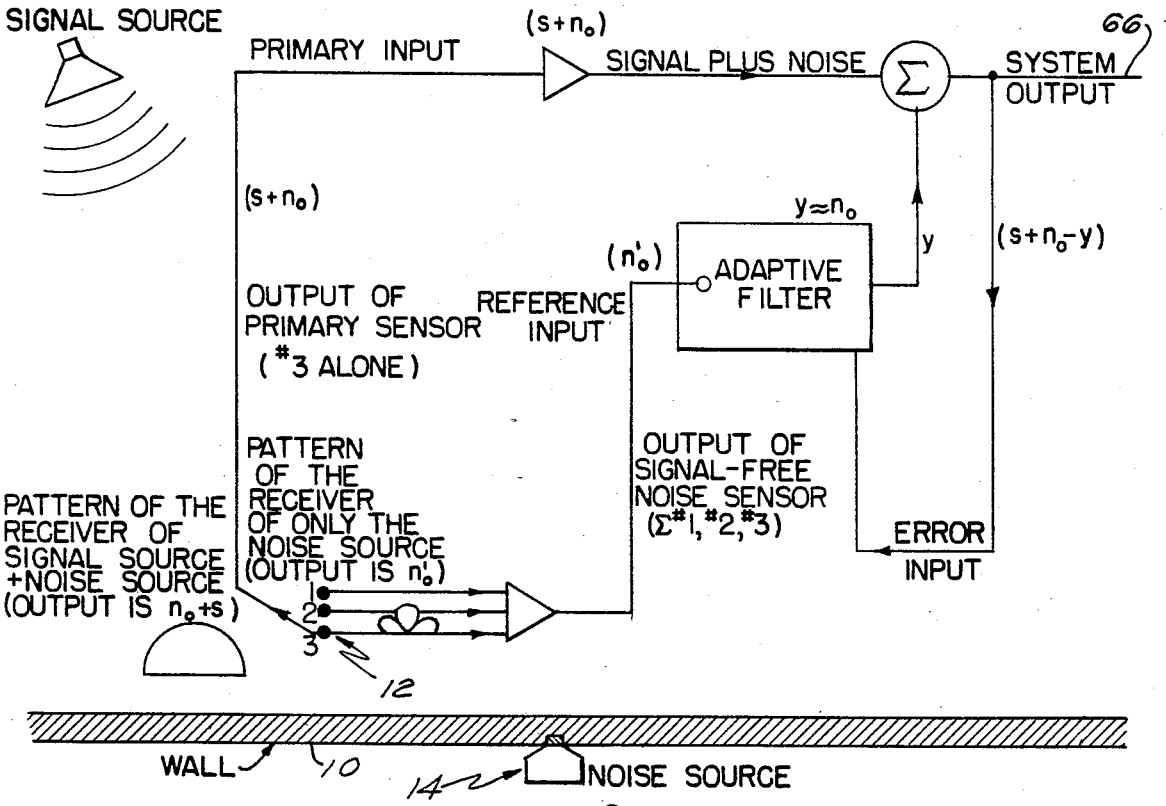
FIG. 6 is a block diagram of a noise-cancelling system built according to the teachings of subject invention.

In subject inventive concept, the primary sensor and the reference sensor are not physically separated, the primary sensor being a portion of the reference sensor itself, as shown in FIG. 6 and FIG. 7. That is, at least one element (e.g., #3) of the reference sensor is used doubly: in the reference sensor and simultaneously in the primary sensor. As a result, the coherence increases between the two sensors. This coherence can be further increased by placing the reference sensor 12 of FIG. 6 or FIG. 7 as close as possible to the wall noise source, and then additionally increased by letting the primary sensor be the element of reference sensor 12 closest to the wall, viz element #3. Element #3 of reference sensor 12 is then not only the primary sensor but is almost the entire reference sensor vs. near-field sound (but not, of course, vs. far-field sound). In this way we have greatly increased the coherence of the near-field noise between the primary sensor and the reference sensor.

We thus have made use of the art of close-talking microphones in combination with the art of adaptive filters.

Also in subject inventive concept the signal-freeness of the reference sensor is improved by using not an accelerometer but a line microphone (e.g., a tripole or a dipole) displaying low sensitivity to the signal source and high sensitivity to the wall noise source.

In explaining the operation of the adaptive filter, we will consider three scenarios:

(a) If a narrow band of noise (say $\Delta f = 10$ Hz) centered around 1000 Hz travels through a medium past two sensors, first past sensor B and then past sensor A, within the correlation time of 0.1 sec, and if response B' is subtracted from response A' (response B' being first bulk-delayed and then equalized by the adaptive filter), the resultant noise response will equal approximately zero, as is desired.

(b) If, however, sensor A contains not noise but a 1000 Hz signal of equal power (say, value 1), while sensor B contains only the narrow band of noise just described, and if the adaptation time of the adaptive filter is made as long as possible (for example, a full 0.1 sec), then subtracting response B' from response A' will give a number (i.e., amplitude value), varying from zero to two. The adaptive filter system will not give a resultant approximating zero. Indeed it might just as well be turned off. The reason is that although the narrowband noise *looks* on the oscilloscope, like a pure 1000 Hz signal, it is actually incoherent with the true 1000 Hz signal and therefore the two will not perform destructive interference. This is similar to Thomas Young's demonstration that light from two different candles, being incoherent with each other, will not form a destructive and constructive interference pattern when allowed to shine through two slits.

(c) Suppose now that sensor A contains both the narrow band of noise and the 1000 Hz signal, while sensor B contains only the narrow band of noise. Let us adaptively equalize sensor B's noise and then subtract it from sensor A's signal-plus-noise. If the adaptation time of the adaptive filter is made as long as possible (for example, the full correlation time of 0.1 sec), then the two noises will cancel to approximately zero, since they are highly coherent with each other; whereas the signal will come through practically undiminished, since it is incoherent with the noise.

Referring to the figures as briefly described above, FIG. 1 schematically shows wall 10 and line microphone 12 comprising three microphone elements, with microphone element #3 being very close to wall 10 and the remaining microphone elements #1 and #2 being situated as shown. Shaker 14 is rigidly attached to wall 10 and is used to set up vibrations in wall 10. The 3-element line microphone 12 is perpendicular to wall 10. The wall noise travels across the line microphone 12 of length d following the laws of the wave equation, and with a 1/r attenuation.

Figure 1:
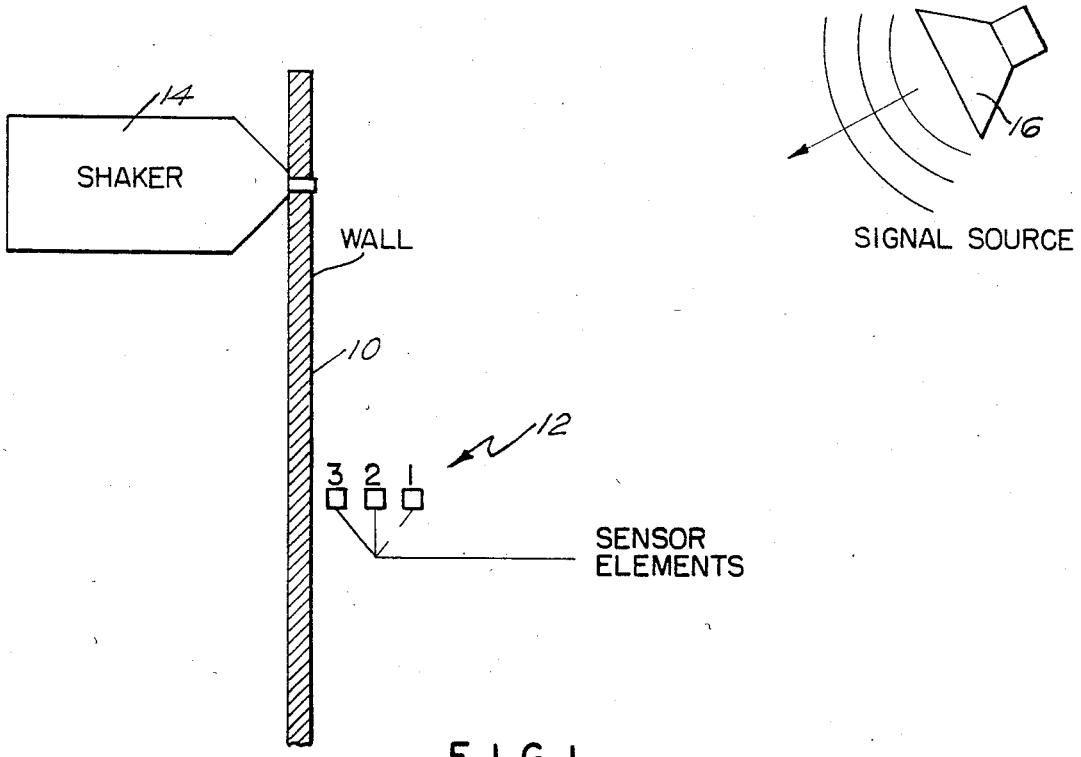
FIG. 1 is a schematic representation of a noise cancelling system according to the teachings of subject invention.

Off to the right as shown in FIG. 1 there is a far-field signal source 16 radiating toward wall 10. This signal source is often a television news announcer. The signal from this source is what we are trying to receive at the line microphone 12 by pulling the signal out of the wall-noise.

Figure 2:
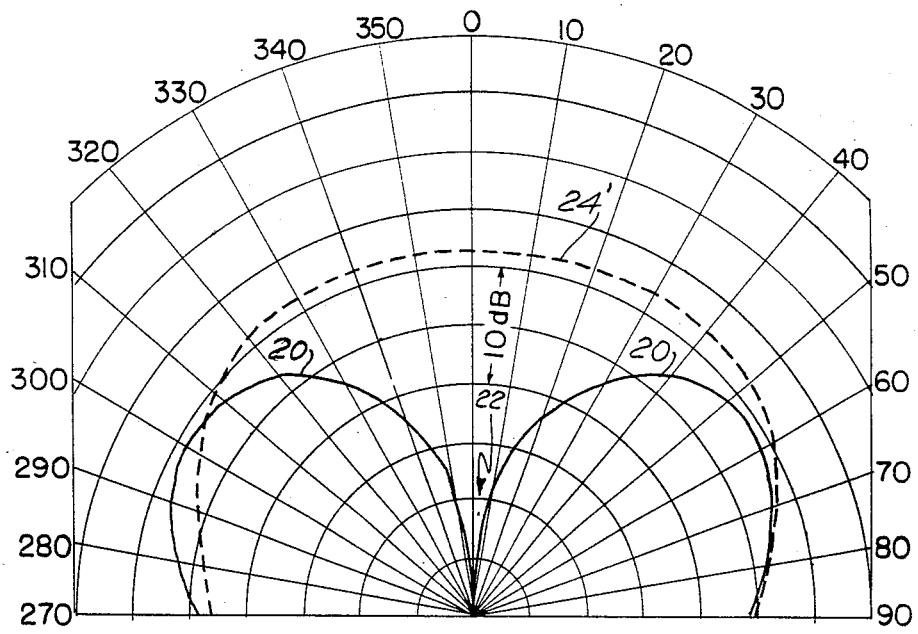
FIGS. 2 and 3 graphically represent the forward directivity patterns of the directional sensor and the omnidirectional sensor respectively.

The 3-element line-microphone is arranged to do two things simultaneously: the complete line microphone 12, a tripole, acts as the reference sensor. It supplies a signal-free wall noise input to the reference channel of the adaptive filter system. It accomplishes this by means of a directivity pattern which has a very low sensitivity toward the forward half-plane (facing the far-field signal source) but a high sensitivity toward the back half-plane (facing the near-field wall-noise source). A simple example of such a directivity pattern is solid curve 20 as shown in FIG. 2. We will call this a "backfire cardioid pattern" having a single null 22 facing the far-field signal source. The back response is not shown but is essentially uniform and of high sensitivity over the back half-plane. The back response picks up all the near-field noise emanating from wall 10. Curve 20 of FIG. 2 is created by feeding each of the three omnidirectional microphone elements 1, 2 and 3 of line microphone 12, after amplification, into its own phase shifter and its own attenuator, adjusting magnitude and phase, and then summing in a summer to create a cardioid pattern. The line microphone 12 is then called a tripole.

Figure 3:
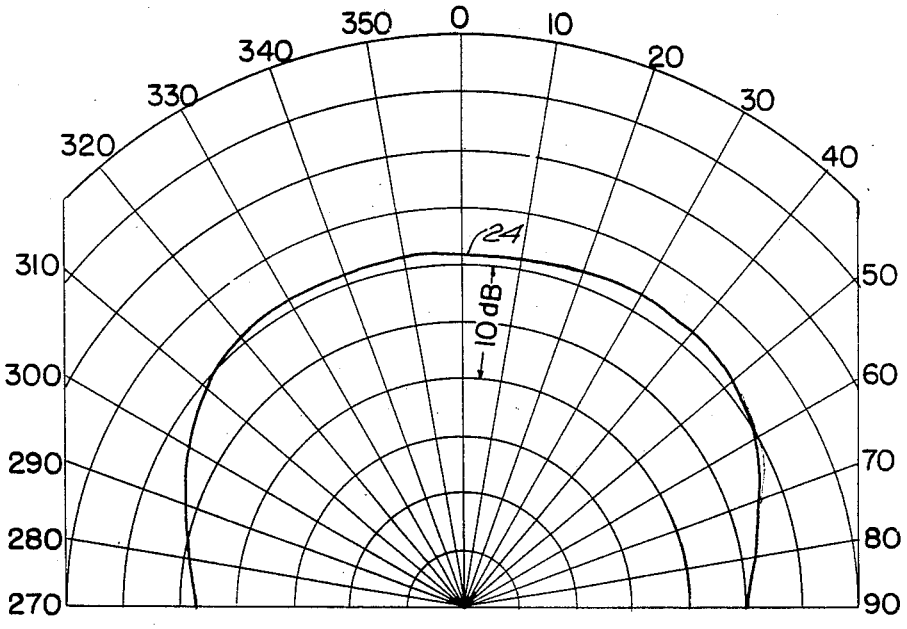

Simultaneously a portion of the tripole 12 acts as the *primary sensor.* One of the three microphone elements, i.e., electroacoustic elements (having, of course, a free-field omnidirectional pattern) feeds signal-plus-noise directly into the primary channel of the adaptive filter system. Note that this microphone element is contributing simultaneously to both the reference channel and the primary channel. The forward half-plane directional response of the primary sensor is shown as curve 24 in FIG. 3. This curve is also shown as dotted curve 24' in FIG. 2. The response is nearly uniform and of high sensitivity over most of the forward half-plane. The back response is not shown here but is essentially uniform and of high sensitivity over the back half-plane, and nearly identical with the back response of the backfire cardioid pattern of FIG. 2, thus allowing a direct comparison between the reference sensor response (solid curve 20) and the primary sensor response (dotted curve 24'). In the angular sector 330° to 30° of FIG. 2 the reference sensor could be considered signal-free because its sensitivity is at least 8 dB lower than the primary sensor's sensitivity.

Figure 4:
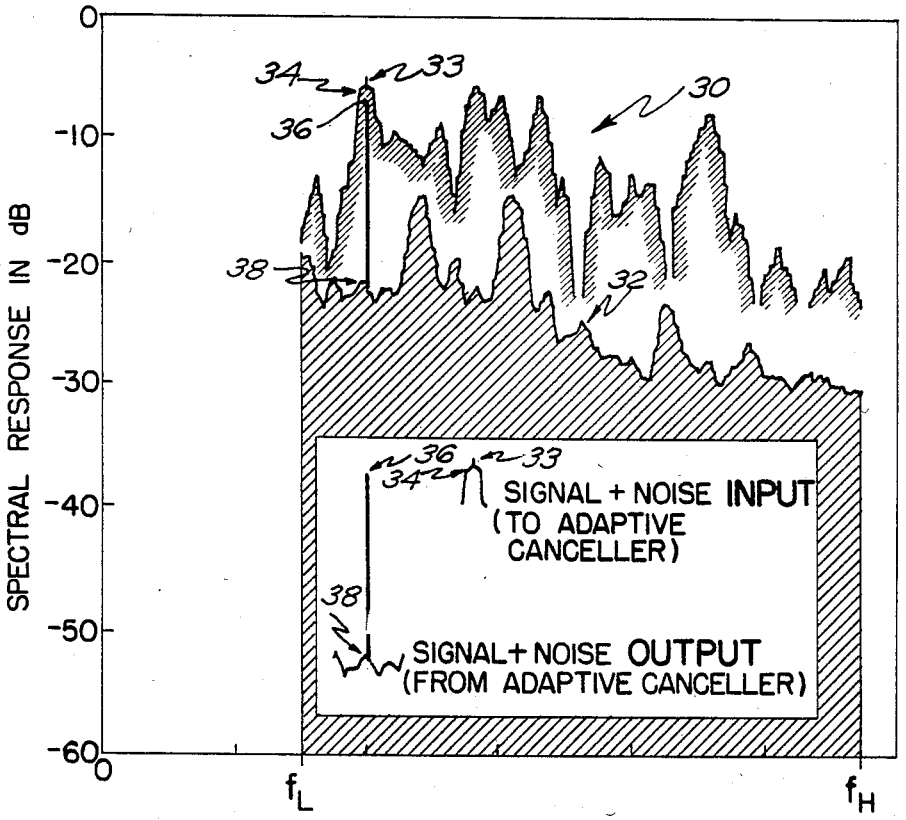
FIG. 4 shows graphically the improvement of the signal-to-noise ratio at the output of the electronic noise-cancelling system.

The reference channel's adaptively adjusted noise is subtracted from the primary channel's signal-plus-noise, leaving a signal having an improved S/N ratio. This is shown in FIG. 4 for a single frequency, where the S/N ratio at the output of the adaptive filter is 17 dB higher than that at the input. Note that the adaptive filter system has reduced the noise over a broad bandwidth.

The upper curve 30 of FIG. 4 shows the spectral response from wall 10 driven by random noise from shaker 14. Superimposed on curve 30 is the spectrum of a single-frequency signal from a far-field source 16 having a spectral level 36 about the same as the noise spectral level 33. The S/N ratio is thus about zero dB. The sum of these two spectra provides the *input* to the primary channel of the adaptive filter system.

The lower curve 32 of FIG. 4 shows the spectral response *output* from the adaptive filter system. The noise spectral response has been reduced over a broad bandwidth, whereas the signal spectral response comes through the system practically untouched as spectral level 36. At the signal frequency, the S/N ratio is increased by 17 dB (note reduced noise spectral level 38).

If now we replace the single-frequency signal with a broadband speech signal, and retain the broadband noise, a signal-to-noise improvement will occur over the whole speech band. The *average* S/N improvement over this band will of course be less than that for the single frequency case of FIG. 4.

Figure 5:
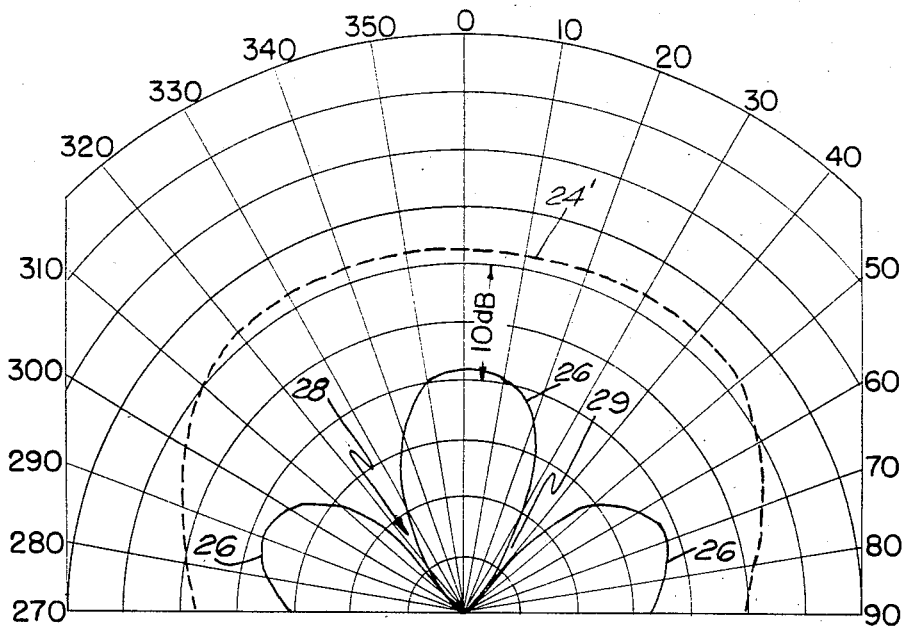
FIG. 5 shows the preferred modification of the directivity pattern shown above in FIG. 2.

FIG. 5 shows a more sophisticated backfire cardioid pattern, curve 26, than that of curve 20 of FIG. 2 (which had only a single null and was signal-free over only about a 60° angle out of the entire 180° of the forward half-plane). In FIG. 5, curve 26, there are *two* nulls, 28 and 29, and an overall attenuation of about 8 dB to 10 dB over the entire 180° forward half-plane. Curve 26 is called a perturbed backfire cardioid pattern. The essentially omnidirectional response of the primary sensor, curve 24', is repeated here to show the comparative forward patterns and sensitivities of the two sensors. The sensitivity in the back half-plane for both sensors is essentially the same.

It should be pointed out that as long as the reference channel's residual source-signal (undesired) is at least 6 dB lower than the primary channel's source-signal (desired), there is the possibility of increasing the signal/-noise ratio by 20 dB or more. That is, there is a nonlinear relationship inherent in the functioning of the adaptive filter, which allows a S/N improvement far greater than is possible from a directional sensor without an adaptive filter.

However, a major limitation to increasing the signal/noise ratio is the imperfect coherence between the noise at the reference channel input and the noise at the primary channel input. A coherence of 90 percent is generally required to achieve a 10 dB increase in signal/noise ratio. A coherence of 99 percent is generally required to achieve a 20 dB increase in signal/noise ratio. Furthermore, since every piece of information in the reference channel that is coherent with information in the primary channel will be subtracted, any residual source-signal in the reference channel will also be subtracted from the source-signal in the primary channel. This subtraction will therefore reduce the expected improvement in signal/noise ratio to less than the 10 dB and 20 dB values mentioned. Hence, the residual source-signal in the "signal-free" reference channel should be at least 6 dB lower than the source-signal in the primary channel. A greater improvement will take place if the residual source-signal is lower by 8 dB or 10 dB.

FIG. 6 shows the essential components needed for a wall-noise-cancelling system. The reference sensor or line microphone 12 in the figure is a 3-element sensor, or tripole, situated perpendicular to the wall. It is also possible to use a 2-element sensor, or dipole, situated perpendicular to the wall. Also, it is possible to situate the tripole or the dipole nearly parallel to the wall, the trade-off being a less bulky mechanical arrangement versus a reduced improvement in signal/noise ratio.

As can be seen in FIGS. 6 and 7, the reference sensor 12 must always use more than one omnidirectional microphone element, whereas the primary sensor need use only one, e.g., #3. However, the system also works well if the primary sensor is #2 alone or #1 alone or even a combination of #1 plus #2 plus #3 if the phases and amplitudes are such that the forward pattern 24 is essentially omnidirectional. Each of the microphone or electroacoustic elements #1, #2 and #3 of line microphone 12 feeds into its respective preamp 40, 42 or 44 of FIG. 7 and thence into its respective phase shifter 46, 48 or 50 and buffer amplifier 52, 54 or 56.

It is highly advantageous to let the reference sensor 12 and the primary sensor have at least one microphone element in common. Thus, in FIGS. 6 and 7, element #3 is used twice, i.e., it is the common element. This ensures high coherence between the noise input in the reference channel and the noise input in the primary channel.

FIG. 7 shows also a more detailed layout of the components used, including monitoring devices. Observe that #3 microphone element or electroacoustic element is used simultaneously in the reference channel 60 and in the primary channel 62 of adaptive filter 64. When *two* sets of phase shifters and *two* summing networks are used, it is even possible to create a 3-element backfire cardioid sensor for the reference channel, and simultaneously a 3-element forward cardioid sensor for the primary channel, using the same set of three elements. The noise-coherence between the two channels is high because the same noise excites the same three elements for both inputs (reference and primary). However, it is sometimes considered undesirable to use a forward cardioid pattern for the primary input (which determines the system output 66) because the frequency response which goes with any cardioid pattern has a 6 dB/ octave slope. This means that at low frequencies, e.g., where $d=\lambda/16$, even the maximum pattern sensitivity is very low (down from its highest value by 14 dB) and that therefore the far-field signal response will be much weaker than is desirable. Hence, it is then preferable to use for the primary input only a single microphone element, having an omnidirectional pattern. This single microphone will have a relatively flat frequency response over the whole frequency bandwidth.

Figure 8:
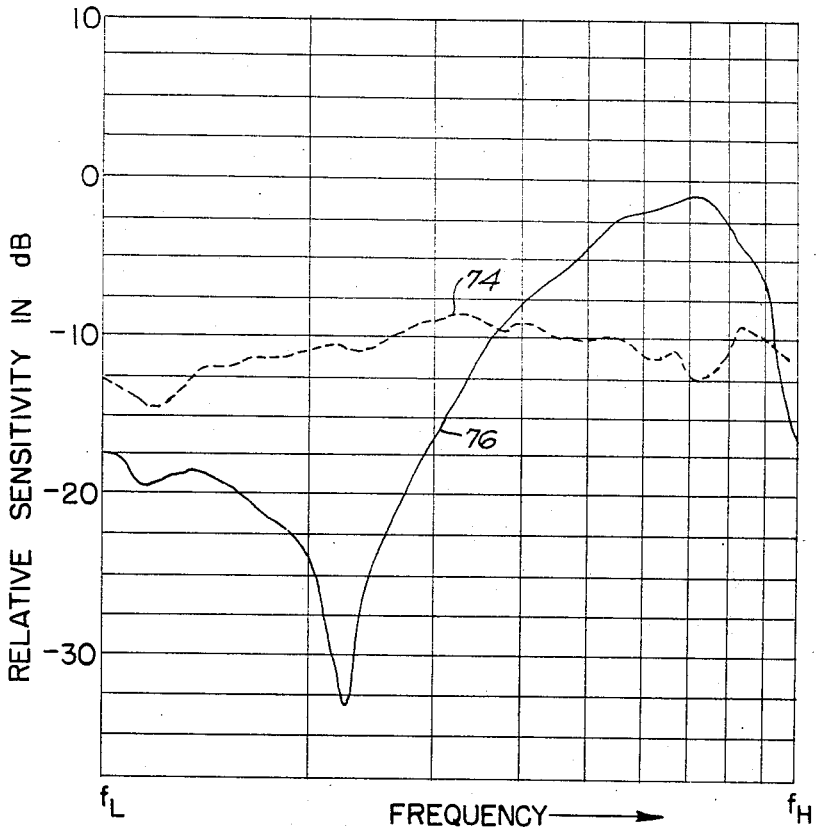
FIG. 8 is a graphical representation of the frequency responses of both the omnidirectional sensor and the directional sensor.

The backfire cardioid pattern used for the reference input will inherently also have a far-field frequency response whose envelope has a 6 dB/octave slope. This is shown in FIG. 8. This means that at low frequencies where $d=\lambda/16$, the far-field maximum pattern sensitivity of the cardioid (pointing now toward the back half-plane) is down 14 dB from its highest value. However, since we are in a near-field situation, the −14 dB value does not hold. And in fact, because of the characteristics of close-talking microphones, the reduction in sensitivity is approximately zero. Thus a backfire cardioid sensor can pick up a strong wall-noise sample to feed into the reference channel. In addition, the sample will be quite signal-free since the forward sensitivity of the sensor is very low.

It should be noted that for $d \leqq \lambda/16$ the backfire cardioid pattern (from a tripole or dipole perpendicular to the wall) can be replaced with a simple figure-8 pattern (from a dipole perpendicular to the wall), since the 14 dB or more drop in far-field sensitivity and the 0 dB drop in near-field sensitivity together assure an acceptable signal-free reference sensor.

It should also be noted that all the distinctive features of the response of the reference channel's sensor, such as, e.g., a frequency response with a 6 dB/octave slope, are irrelevant to the system output 66 (FIGS. 6 and 7) because the reference channel acts merely as a temporary scaffolding. The channel that determines the input to our ultimate receiving device, the headphone pair 74, is the primary channel. That is, the information that goes to the headphones 74 comes from the system output, which itself is determined only by the primary channel. And if the primary channel's sensor is a single omnidirectional element, then the system output frequency response will be relatively flat.

FIG. 7 also shows that the cardioid patterns can be examined with the help of a pattern recorder 70 inserted ahead of the adaptive filter 64. The coherence between the two channels can be monitored by a coherence indicator 72. The system output going to the headphones 74 can be examined with the help of a spectrum analyzer 68.

It should be noted here that the signal-freeness of the reference sensor, as shown by curve 26 of FIG. 5, can be improved by creating a higher-order backfire cardioid pattern, e.g., by using six omnidirectional microphone elements in a line instead of the three electroacoustic elements of line microphone 12. This reduces the response of the backfire cardioid lobes by an even greater amount than the 8 dB to 10 dB shown in curve 26 of FIG. 5. A decision to use higher-order patterns is based on a tradeoff of financial cost versus signal-freeness.

Returning to the discussion of flat frequency response and 6 dB/octave slopes, we see in FIG. 8, curve 74, the relatively flat frequency response of a single omnidirectional microphone element located close to the wall.

The non-flat far-field frequency response of the backfire cardioid sensor is shown in curve 76 of FIG. 8. At the chosen signal frequency, for which the cardioid pattern was optimized, a directional null exists in the pattern. The relative orientation of sensor 12 and wall 10 was such as to let the directional null face the standard artificial voice 58 of FIG. 7. With a fixed setting of the three phase shifters of FIG. 7, and a fixed angular orientation of sensor and wall, there is only a single, rather sharp, null region in the frequency response (curve 76 of FIG. 8.) The useful bandwidth of the null region is about a half-octave. This is the region over which the response is down at least 8 dB compared to the omnidirectional curve 74.

At frequencies above and below the null frequency, the frequency response somewhat resembles that of a normal forward-looking cardioid system. The reason is that the fixed phase angles selected to form the backfire cardioid pattern are optimum only over about a half-octave. Beyond this null region a new setting of phase angles is required. Thus if a bandwidth of, say, a decade or about 3½ octaves is to be covered, the necessary modifications can be accomplished in any of several ways. One way is to divide the frequency bandwidth shown in FIG. 8 into, say, seven frequency bins (using contiguous half-octave bandpass filters), all in parallel. Each bin contains a phase shifter and amplifier which provide the optimum phase value and amplitude value to form a backfire cardioid for that frequency region. When the contents of the seven bins are summed and fed into the reference channel of the adaptive filter, the resulting frequency response is the same as if from a broad band-elimination filter, with the null covering a complete decade.

Figures 9, 10A, 10B, 10C, 11A, 11B, 12:
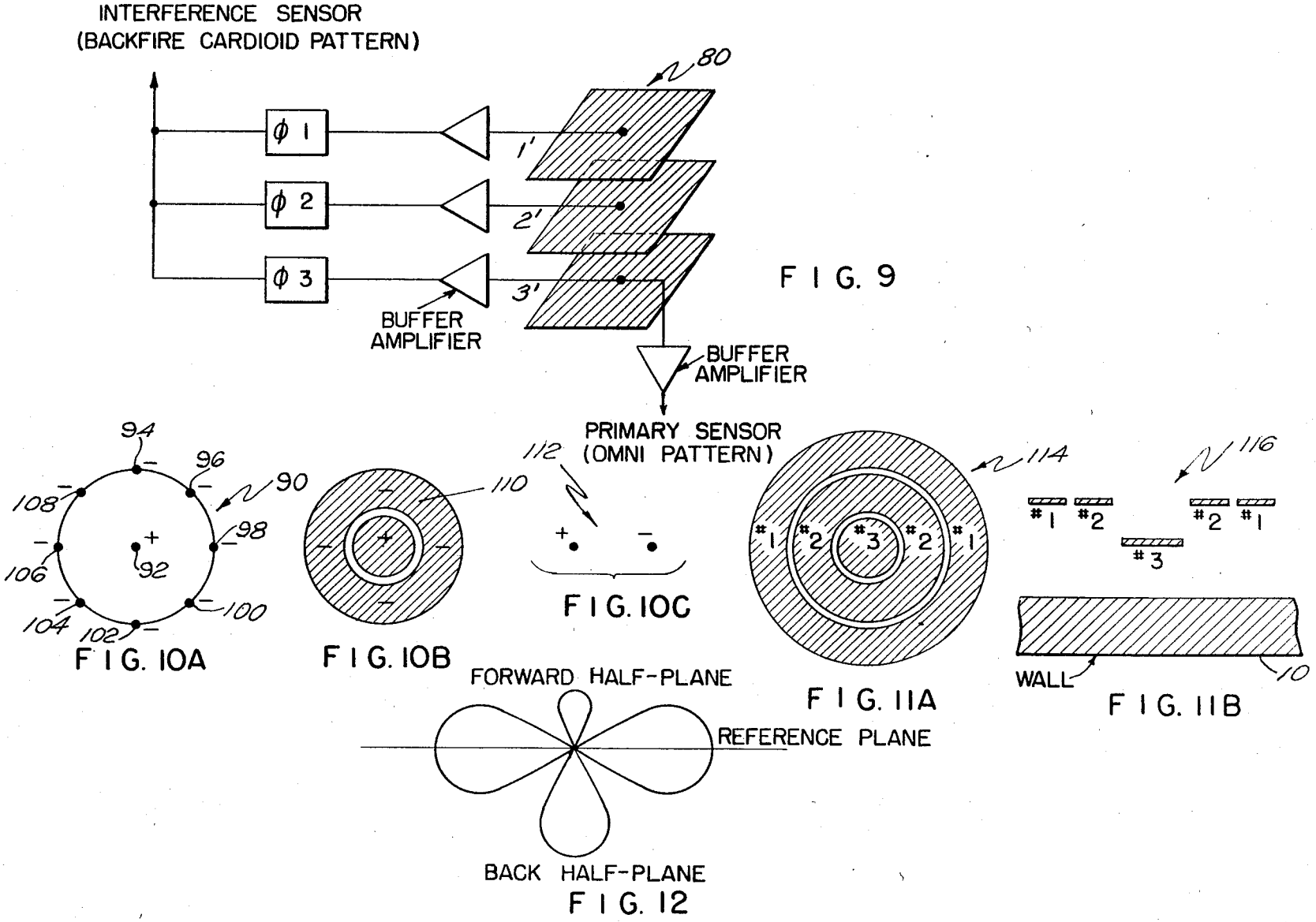
FIG. 9 diagrammatically shows a variant of the line microphone where an area-element replaces each of the point-elements of FIG. 7.
FIG. 10A is a representation of an in-plane circular dipole including a central point element and a circular ring having eight point elements.
FIG. 10B is a representation of an in-plane circular dipole including a central disc element and an annular strip encompassing it.
FIG. 10C is a representation of an in-plane linear dipole parallel or nearly parallel to the wall.
FIG. 11A is a representation of an in-plane circular tripole similar to the dipole of FIG. 10B.
FIG. 11B shows an almost in-plane tripole of rotation wherein ring #3 (the central disc) is pulled out of the plane by a small distance.
FIG. 12 shows one of the possible directivity patterns obtainable from the tripole of FIG. 11B.

FIGS. 1, 6 and 7 depict the three microphone or electroacoustic elements as three point-sensors. Sometimes it is desirable to use area microphone elements in place of the point microphone elements. FIG. 9 shows a variant 80 of the line microphone 12 where area microphone elements 1', 2', 3' replace the point microphone elements 1, 2, and 3 of FIG. 7.

Instead of three microphone elements positioned perpendicular to the wall (a volumetric sensor) for creating the reference sensor, it is sometimes desirable to use a planar sensor as shown in FIG. 10A. An in-plane dipole-of-rotation may be approximated, using a ring 90 of acoustically sensitive material surrounding a central point-element 92. Ring 90 can consist either of discrete elements such as 94, 96, 98, 100, 102, 104, 106 and 108 as shown in FIG. 10A, or of a continuous strip, 110, as shown in FIG. 10B. The basic free-field pattern in each case is a toroid, parallel to the wall. An in-plane linear dipole 112, may also be used, as shown in FIG. 10C. The basic free-field pattern is a dumbbell, nearly parallel to the wall. An in-plane tripole of rotation 114 can also be used, as shown in FIG. 11A. This can be phased to yield a free-field pattern which is a toroid with a small central lobe superposed symmetrically above and below the center null. A variant 116 of the in-plane tripole is shown in FIG. 11B, where ring #3 (the central disc) is pulled out of the plane through a small distance. This breaks up the symmetry of the pattern of the in-plane tripole, and allows the central lobe to be small facing the forward half-plane and much larger facing the back half-plane where the noise source is located. FIG. 12 shows one of the possible free-field directivity patterns obtainable from tripole 116. Other variants having any one of the three rings out the plane and the remaining two rings in the plane, are also feasible.

In all the above-mentioned examples of the planar sensors, just as with the volumetric sensors, one element is used doubly. It is used simultaneously in the reference channel and the primary channel.

It is well worth pointing out the following three points in this inventive concept: (1) the noise must be highly correlated over the full extent of the line microphone. Otherwise subtraction by the two channels will do no good. (2) The noise-to-signal ratio should be greater in the reference channel than in the primary channel. That is, in the reference channel the signal should be as weak as possible. (3) The signal should be uncorrelated with the noise. Otherwise, the signal will masquerade as noise and become reduced.

Also it should be emphasized that the signal-freeness of the reference sensor is accomplished by creating a backfire cardioid pattern which has a low sensitivity over a broad angular region facing the signal source. Alternatively, it is often possible to substitute a figure-eight pattern for this backfire cardioid pattern, especially when the figure-eight's dipole has a length $d<\lambda/16$.

The foregoing discussion clearly shows that an electronic noise-reducing system built according to the teachings of subject invention greatly enhances signal-to-noise ratio (S/N) by using an adaptive filter, a primary sensor and a reference sensor having at least one common microphone element or electroacoustic element. The primary sensor acts as an omnidirectional detector toward signals from a far-field source. The reference sensor has at least one of its microphone elements or electroacoustic elements common with that of the primary sensor and acts as a directional detector against signals from a far-field source. Both the primary sensor and the referense sensor respond to the noise from a near-field noise source equally strongly. The conditioned output of the reference sensor is further conditioned, both in phase and amplitude by an adaptive filter or equalizer, and then summed with the output of the primary sensor so as to obtain reduced noise level. The resulting signal-to-noise ratio is thereby greatly increased.

Many modifications and variations of the presently disclosed invention are possible in the light of the above teachings. As an example, the primary sensor and the reference sensor can be area detectors instead of being point detectors without deviating from the teachings of subject invention. Furthermore, any one of the microphone or electroacoustic elements of the reference sensor can be the common electroacoustic element for the primary sensor. It is, therefore, understood that within the scope of the appended claims, the invention may be practiced otherwise than as specifically described.

I claim:

1. An electronic noise-reducing system utilizing an adaptive filter fed by at least two sensors, namely a directional reference sensor comprising at least two electroacoustic elements, and an omnidirectional primary sensor, wherein at least one electroacoustic element of the reference sensor is used both in the reference sensor and simultaneously in the primary sensor.

2. An electronic noise-reducing system as in claim 1 wherein said directional reference sensor comprises at least two electroacoustic elements phased and attenuated to create a perturbed cardioid pattern displaying relatively low sensitivity toward a far-field source located on one side of said directional sensor while simultaneously displaying its maximum sensitivity toward a near-field noise source on the opposite side of said directional sensor.

3. An electronic noise-reducing system as in claim 1 wherein said directional reference sensor comprises at least two electroacoustic elements phased and attenuated to create a figure-8 pattern with a pattern maximum facing said far-field source located on one side of said reference sensor and said reference sensor displaying a relatively low sensitivity toward said far-field source, and with the said sensor simultaneously displaying a relatively high sensitivity toward said near-field noise source on the opposite side of said reference sensor.

4. An electronic noise-reducing system as in claim 1 wherein that electroacoustic element of said reference sensor used simultaneously as the primary sensor is the element closest to the near-field noise source.

5. An electronic noise-reducing system as in claim 1 wherein the directional reference sensor comprising at least two electroacoustic elements is a line microphone having the axis thereof positioned at an angle to the plane of said near-field noise source.

6. An electronic noise-reducing system as in claim 1 wherein the directional reference sensor comprising at least two electroacoustic elements is a line microphone with axis thereof perpendicular to the plane of said near-field noise source.

7. An electronic noise-reducing system for detecting signals from a signal source in the presence of a near-field noise-source which comprises:

a reference sensor including a plurality of electroacoustic elements situated farther away from said signal source than from said near-field noise source, said reference sensor acting as a directional detector;

a primary sensor including at least one of said plurality of electroacoustic elements of said reference sensor being used simultaneously as a common electroacoustic element in said primary and reference sensors, said primary sensor acting as an omnidirectional detector;

a reference phase shifter and attenuator for conditioning the output of said reference sensor;

adaptive filter means for changing the amplitude and phase of said conditioned output of said reference sensor; and means for summing the adaptive filter output of said primary sensor and conditioned output of said reference sensor to obtain an output thereof having increased signal-to-noise ratio.

* * * * *